US005213609A

United States Patent [19]

Hyde et al.

[11] Patent Number: 5,213,609

[45] Date of Patent: May 25, 1993

[54] PROCESS FOR EXTRACTING PRECIOUS METALS

[75] Inventors: Leo J. Hyde, Berowra Heights; Michael Stoychevski, Brighton-Le-Sands, both of Australia

[73] Assignee: Du Pont (Australia) Limited, North Sydney, Australia

[21] Appl. No.: 733,502

[22] Filed: Jul. 22, 1991

[30] Foreign Application Priority Data

Jul. 20, 1990 [AU] Australia ..... PK1290

[51] Int. Cl.[5] ..... C22B 3/44

[52] U.S. Cl. ..... 75/744

[58] Field of Search ..... 75/744

[56] References Cited

U.S. PATENT DOCUMENTS 5,034,055 7/1991 Rowson ..... 75/744

5,071,477 12/1991 Thomas ..... 75/744

*Primary Examiner*—Peter D. Rosenberg

*Attorney, Agent, or Firm*—Earl L. Handley

[57] ABSTRACT

The invention relates to a method of extracting gold from a gold-containing material. The invention provides a process of extracting precious metals from a precious metal-containing material comprising mixing the material in a finely-divided state with an alkaline cyanide solution to form a mixture and recovering the metal from solution by known methods characterized in that said process is carried out in the presence of peroxymonosulfuric acid or salt thereof and, where necessary, adding oxygen or a source thereof to said mixture to provide a dissolved oxygen level of at least about 6 ppm.

In a preferred embodiment the process is used in conjunction with a carbon-in-pulp plant. In the preferred process ore slurry 2 is passed through a valve means 3*a* to a wood screen 5 via line 4*a*. The slurry is separated from waste wood splinters 5*a* under gravity to a reservoir 6 where it is combined with an alkaline cyanide solution 7 introduced via line 4*b* and metering pump 8*a*. The slurry mixture is then introduced into a first leach tank 9*a* via line 4*c*, metering pump 8*b* and valve means 3*b*. The slurry is then agitated using an agitated drive 11*a* in the presence of a triple salt which has been introduced via line 4*d*, metering pump 8*c* and valve means 3*c* and also in the presence of activated carbon 12 which can be introduced into any of the tanks, typically 9*f* and returned into the previous leach tanks and ultimately tank 9*a* via lines 4*e* to 4*i* and pumps 8*d* to 8*h*. The mixture is then passed through self cleaning carbon screen 13*a* to remove loaded carbon 14 to a second leach tank 9*b* where it is agitated by agitated drive 11*b*. The mixture is then passed through a second carbon cleaning screen 13*b* to a third leach tank 9*c* and subsequently through tanks 9*d* to 9*f*. Slurry is also returned into the previous tanks via lines 4*e* to 4*i* and pumps 8*d* to 8*h*. Air or oxygen can also be introduced into any of the tanks typically tanks 9*c* or 9*d*. The triple salt may also be added to any one of tanks 9*b* to 9*f* via valve means 3*d* to 3*h*. After the slurry/carbon mixture has proceeded through all the tanks, carbon fines 15*a* are removed using a carbon fine screen 15 to give an end solution 16 which is separated from the tailings 17 by metering pump 8*i* and valve means 3*i*. The end solution 16 is then extracted for gold using known methods.

9 Claims, 3 Drawing Sheets

PROCESS FOR EXTRACTING PRECIOUS METALS

TECHNICAL FIELD

This invention relates to a method of extracting gold from a gold-containing material.

BACKGROUND ART

In the mining industry, gold from gold ore is generally extracted by milling the gold ore sufficiently to allow separation of the gold and then utilizing various recovery processes such as amalgamation, cyanidation, gravity concentration, flotation and roasting or a combination of any of these. A common process used in the art is that of cyanidation. In the process of cyanidation the ore (or tailings) is leached with an alkaline cyanide solution, usually a solution of sodium cyanide (0.02–0.3%) or an equivalent of calcium cyanide together with a quantity of alkali such as lime or caustic soda in the presence of air (oxygen) or hydrogen peroxide. It is generally believed that the dissolution of gold by cyanidation occurs by the following equation:

$$2Au+4NaCN+\tfrac{1}{2}O_2+H_2O \rightarrow 2Na(Au(CN)_2)+2Na(OH)$$

Air is a somewhat inefficient source of oxygen. It has been suggested that use of pure oxygen would optimize the process and this has been found to improve the recovery of gold as the rate of dissolution of gold is directly proportional to the oxygen content of the gas used for aeration.

Following cyanidation gold is then recovered by known means such as treating the solution with zinc dust or aluminium (Merrill-Crowe process); or removing gold from solution with activated carbon and then stripping the gold from the carbon with alcoholic caustic and reactivating the carbon by controlled roasting. The latter process is particularly suitable in the leaching or dilute ores by the carbon-in-pulp (CIP)/carbon-in-leach (CIL) process.

Generally, recovery of about 90% of the contained ore can be obtained with 10% of the gold being retained in the ore (refractory ore). In some ores the presence of base metals and silver will lead to an intolerably high consumption of cyanide. Economically, a cyanide usage of 1 to 2.5 kg NaCN per metric ton of ore is desired. A further disadvantage is that some gold containing ores may contain organic matter, ferrous compounds, arsenopyrite and/or pyrrhotite which may represent the major part of the oxygen demand.

OBJECT OF THE INVENTION

It is an object of this invention to provide an improved cyanidation process.

DISCLOSURE OF INVENTION

The present inventors have found that addition of peroxymonosulfuric acid or a salt thereof to the cyanidation process leads to an increase in the amount of precious metals e.g. silver, copper, or gold.

According to a broad form of the present invention there is provided a process of extracting precious metals from a precious metal-containing material comprising mixing the material in a finely-divided state with an alkaline cyanide solution to form a mixture and recovering the metal from solution by known methods characterized in that said process is carried out in the presence of peroxymonosulfuric acid or salt thereof and, where necessary, adding oxygen or a source thereof to said mixture to provide a dissolved oxygen level of at least about 6 ppm.

The invention also provides precious metals recovered from a material containing them by a process according to the invention.

In the following disclosure the extraction of gold using a triple salt will be discussed, but the invention should not be construed as being limited thereto.

The process is usually carried out using the triple salt comprising two moles of potassium monopersulfate (potassium peroxymonosulfate, $KHSO_5$), one mole of potassium hydrogen sulfate ($KHSO_4$) and one mole of potassium sulfate ($K_2SO_4$).

The triple salt is a white, granular, free-flowing powder. Potassium monopersulfate is the active component with the chemical structure:

Typically th etriple salt has the following properties:

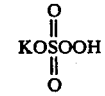

| | |
|---|---|
| Molecular Weight | 614.7 |
| Active Oxygen, % min. | 4.5 |
| % theoretical | 5.2 |
| Bulk Density, g/cm$^3$ (Mg/m$^3$) | 1.12–1.20 |
| Particle size through U.S.S. #20 Sieve, % | 100 |
| through U.S.S. #200 Sieve, % | 10 |
| pH, @25C 1% solution | 2.3 |
| 3% solution | 2.0 |
| Solubility, g/100 g $H_2O$ at 20C | 25.6 |
| Moisture content, % | 0.1 |
| Stability, % active oxygen loss/month | 1 |
| Standard Electrode Potential (E), volts | −1.44 |
| Heat of decomposition, kj/kg | 77 |
| Btu/lb | 33 |
| Thermal conductivity, W/m · K | 0.14 |
| Btu · ft/h · ft$^2$ · F | 0.08 |

The process may be conducted in the presence of air or oxygen. In some instances it may be advantageous to control the pH of the leach by addition of an alkali such as lime or caustic soda. Typically the pH is maintained between 11.0/11.5 and 9.5 preferably less than 10.5 most preferably less than 10.0, the amount of gold extracted increasing at lower pH. At pH's greater than 11.5 decomposition of the triple salt can increase.

The process of the present invention may be used in conjunction with a carbon-in-pulp process.

The dissolved oxygen level should be at least about 6 ppm preferably at least about 8 ppm.

The amount of triple salt added can vary depending on the type of ore to be treated. Generally, 30 gram to about 1 kilogram per tonne of ore will be used. Most preferably 30 gram per tonne of ore is used Amounts may be greater for refractory or highly refractory ores however an amount greater than 1 kilogram per tonne may be detrimental to gold dissolution. It is preferable that the triple salt is added as a dilute solution rather than a solid and added in an amount such that the initial Eh of the solution falls between −50 and 0 mV relative to a standard calomel electrode and the change in $\Delta Eh/\Delta dt = -k$. Additions in an amount giving a potential greater than 0 mV can result in a distinct drop in the level of gold extracted.

BEST MODES OF CARRYING OUT THE INVENTION

Figure 1A:
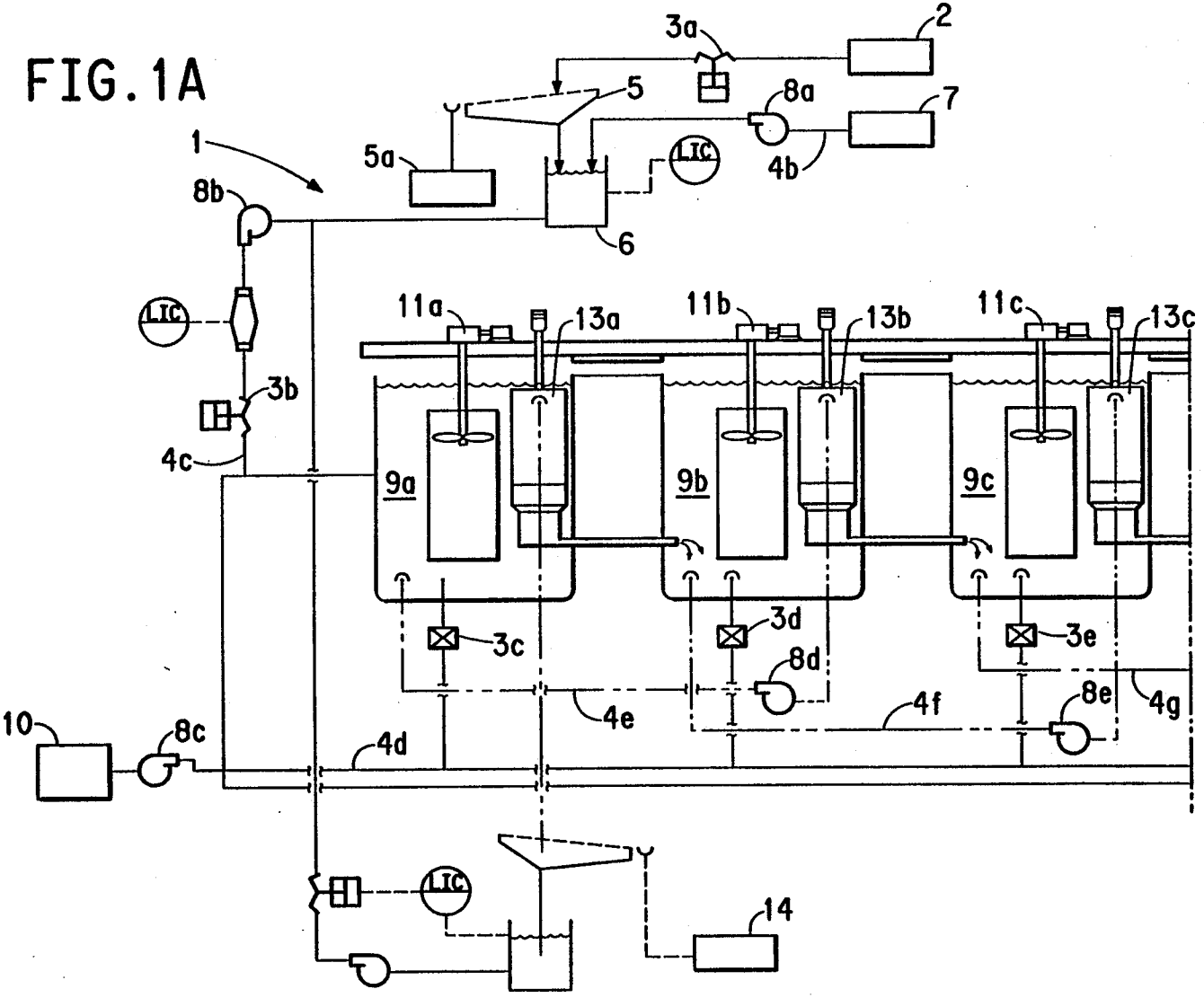
FIGS. 1A and 1B are a schematic diagram of a CIP plant.
Figure 1B:
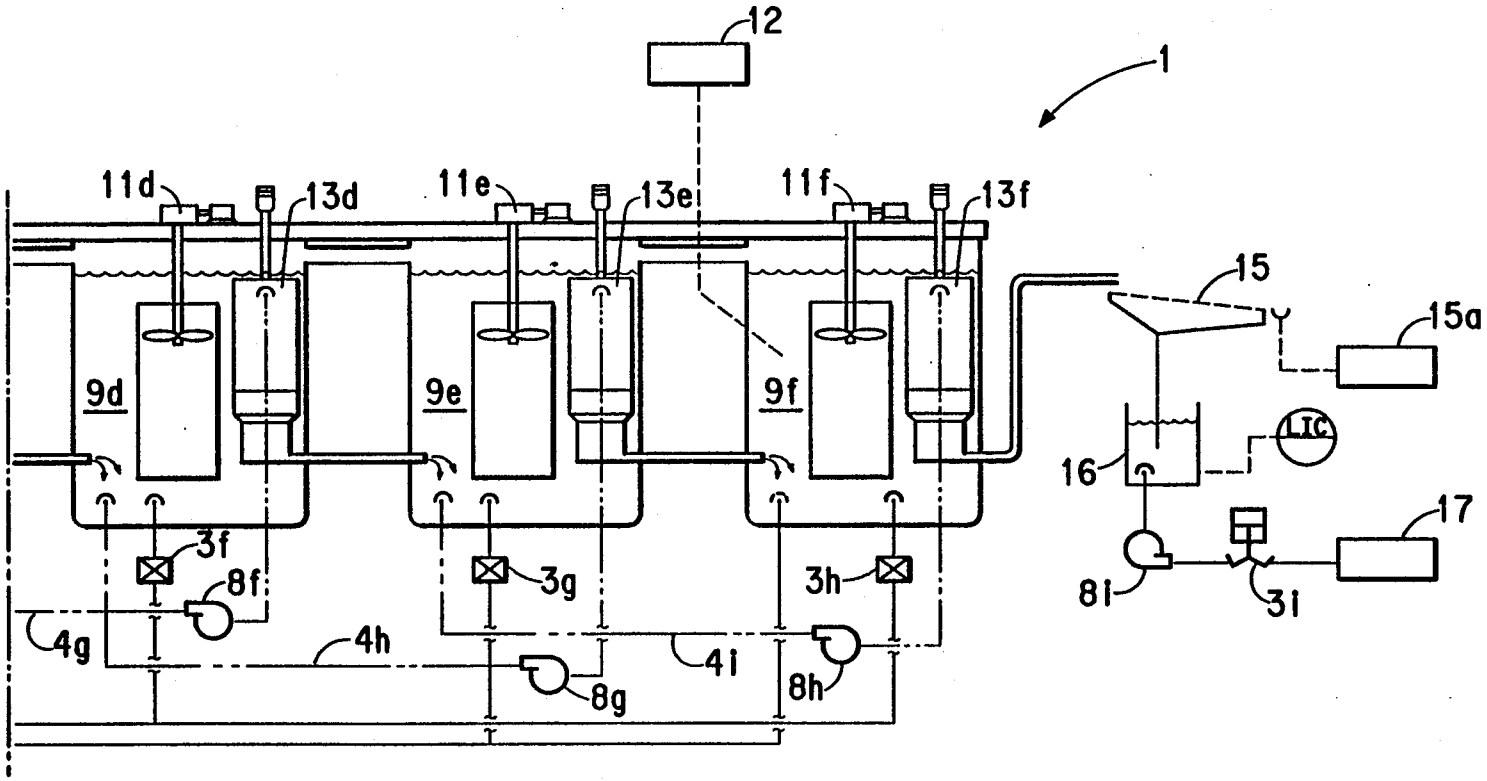

Referring to FIG. 1 a process for the extraction of gold using a CIP plant is shown 1. Ore slurry 2 is passed through a valve means 3*a* to a wood screen 5 via line 4*a*. The slurry is separated from waste wood splinters 5*a* under gravity to a reservoir 6 where it is combined with an alkaline cyanide solution 7 introduced via line 4*b* and metering pump 8*a*. The slurry mixture is then introduced into a first leach tank 9*a* via line 4*c*, metering pump 8*b* and valve means 3*b*. The slurry is then agitated using an agitated drive 11*a* in the presence of a triple salt 10 which has been introduced via line 4*d*, metering pump 8*c* and valve means 3*c* and also in the presence of activated carbon 12 which can be introduced into any of the tanks, typically 9*f* and returned into the previous leach tanks and ultimately tank 9*a* via lines 4*e* to 4*i* and pumps 8*d* to 8*h*. The mixture is then passed through a self cleaning carbon screen 13*a* to remove loaded carbon 14 to a second leach tank 9*b* where it is agitated by agitated drive 11*b*. The mixture is then passed through a second carbon cleaning screen 13*b* to a third leach tank 9*c* and subsequently through tanks 9*d* to 9*f*. Slurry is also returned into the previous tanks via lines 4*e* to 4*i* and pumps 8*d* to 8*h*. Air or oxygen can also be introduced into any of the tanks typically tanks 9*c* or 9*d*. The triple salt may also be added to any one of tanks 9*b* to 9*f* via valve means 3*d* to 3*h*. After the slurry/carbon mixture has proceeded through all the tanks, carbon fines 15*a* are removed using a carbon fine screen 15 to give an end solution 16 which is separated from the tailings 17 by metering pump 8*i* and valve means 3*i*. The end solution 16 is then extracted for gold using known methods.

The following Examples illustrate preferred embodiments of the process of the invention and should not be construed as limiting on the scope of this invention.

In the following Examples a refractory ore high in arsenic and sulfur was used. Fire assays of a sample of ore used in the Examples revealed that the ore is rich in sulfur and excess lead had to be used to collect the gold. The ore is thus oxygen deficient and particularly reducing in nature.

Comparative Example 1

50 g of ore was used. The reaction was performed in a glass reaction vessel with a stirrer. A 2:1 liquid to solid radio was used, i.e. a reaction volume of 100 ml. pH 10.5 and leach time of 24 hours. No extra additions of alkali were made during the leach as the pH gradually increased with time.

The amount of gold extracted was determined from assay of gold in the solution using atomic absorption. The results are shown in the following table:

| Run | Cyanide (g) | Au extracted (g/t) | Residual CN (g) | % of CN remaining | CN used (g) |
|---|---|---|---|---|---|
| 1 | 0.1 | 0.46 | 0.006 | 6.0 | 0.094 |
| 2 | 0.2 | 0.70 | 0.018 | 9.1 | 0.182 |
| 3 | 0.5 | 0.87 | 0.078 | 15.6 | 0.422 |
| 4 | 1.0 | 0.93 | 0.245 | 24.5 | 0.755 |

Comparative Example 2

In case the method of agitation, using an open beaker on a flat bed shaker, may not have provided the same aeration as used in the field, Runs 1 to 4 of Comparative Example 1 were repeated with air also being bubbled into the solution. Results indicated that the dissolution of gold increased by a factor of 2 but the consumption of cyanide also increased after 24 hours.

Despite initial concentrations of cyanide equivalent to 25 kg/t of ore only 15% of the gold appeared to have been extracted after 24 hours with 25% of free cyanide remaining.

Comparative Example 3

100 g of ore was used. The reaction was performed in a glass reaction vessel with a stirrer. A 2:1 liquid to solids ratio was used, i.e. a reaction volume of 200 ml, pH of 10.5 and with addition of CN in 5 stages corresponding to initial, 2, 4, 10 and 20 hours, leach time was 24 hours. Some air agitation was provided. The results are shown in the following table:

| Run | Cyanide (g) | Au extracted (g/t) | Residual CN (g) | % of CN remaining | CN used (g) |
|---|---|---|---|---|---|
| 1 | 0.2 × 5 = 1.0 | 0.45 | 0.162 | 16.2 | 0.84 |
| 2 | 0.3 × 5 = 1.5 | 0.59 | 0.305 | 20.3 | 1.20 |
| 3 | 0.4 × 5 = 2.0 | 0.63 | 0.510 | 25.5 | 1.49 |
| 4 | 0.5 × 5 = 2.5 | 0.65 | 0.715 | 28.6 | 1.79 |

Comparison of Run 3 of Comparative Example 1 with Run 1 above shows that although the proportion of CN used is about the same the amount of gold extracted in this example is about half. Comparison of Run 4 of Comparative Example 1 with Run 3 above shows that although the proportion of CN used is about the same the amount of gold extracted in less. The addition of cyanide in stages has not assisted gold dissolution. It is thought that the dissolution of gold is dependent on the cyanide concentration rather than the quantity of cyanide added.

Runs 1 to 4 were continued for another 24 hours with no significant increase in gold dissolution.

Inspection of the ore under a scanning electron microscope using a Rutherford backscattering detector showed no obvious signs of metallic gold within the size range of the instrument. It would appear that the gold particles are very finely dispersed (nm range) within the sulfide matrix. The material is a refractory type ore high in metal sulfides which encapsulate the finely divided gold particles.

Comparative Example 4

In this example air was bubbled through the slurry under similar conditions as used in Comparative Example 3 i.e. 100 g ore, 200 ml water, pH 10.5 for 24 hours. The slurry was stirred continuously with a blade stirrer and air was introduced to the slurry through a porous membrane (Micro 2) throughout the experiment. Dissolved oxygen was measured using a calibrated meter and was kept above the upper range of the instrument i.e. 20 ppm. The Eh at various intervals in the experiment was 0.0 mV (initial pH 10.5 without $CN^-$), −260 mV (after addition of 0.5 g $CN^-$), −205 mV (after 4 hours of leach). The results are shown in the following table:

| Run | Cyanide (kg/t) | Au extracted (ppm) At 4 h | Au extracted (ppm) At 24 h | % Au extracted 24 h | Eh (mV) 4 h | Free $CN^-$ % |
|---|---|---|---|---|---|---|
| 1 | 2.5 | 1.35 | 1.6 | 24 | −205 | 80 |
| 2 | 5.0 | 1.4 | 1.7 | 26 | −220 | 80 |
| 3 | 10.0 | 1.55 | 1.8 | 27 | −250 | 80 |
| 4 | 20.0 | 1.80 | 2.05 | 31 | −310 | 80 |

It can be seen from the above Table that the introduction of air into the leach solution has increased the proportion of gold recovered. The most interesting aspect of this experiment is the low potential of the leach solution. Even with the introduction of compressed air the potentials after 4 hours indicate a reducing environment relative to a saturated potassium chloride electrode (calomel). With such low potentials addition of extra cyanide is counteracted by a further lowering of potential.

Comparative Example 5

Comparative Example 4 was repeated however in this experiment oxygen instead of air was used. Preliminary results using oxygen instead of air were not significantly different to those shown above.

Comparative Example 6

In order to raise the solution potential it was decided to reduce cyanide concentration and increase leach volume. In this experiment 200 g. ore in 1 liter at pH 10.5 was used. Both oxygen and air were introduced. The Eh prior to the addition of base or cyanide was $Eh_i = -215$ mV. The pH before addition of the base was $pH_i = 5.1$. With the addition of 0.5 g sodium cyanide in the presence of oxygen the Eh changed as follows:

| Time (h) | Eh (mV) | pH |
|---|---|---|
| 0.5 | −230 | 10.4 |
| 1.0 | −220 | — |
| 1.5 | −210 | 10.65 |
| 3.0 | −195 | — |
| 4.0 | −170 | 10.85 |

The amount of gold extracted after 4 hours was 1.85 g/t i.e. 28%. This result should be compared with the first line in the previous table where 2.5 kg of cyanide gave an extraction of 24%. It appears that at higher potentials less cyanide reagent is required for an equivalent extraction at higher cyanide concentrations and lower potentials.

EXAMPLE 1

In this example the triple salt oxone TM monopersulfate was added. The active component of oxone monopersulfate is $KHSO_5$ with an E = −1.44 v. The following table summarises the experimental results obtained using the triple salt at a 5:1 liquid to solid ratio and with a 4 hour residence time. The initial pH was 10.5. The triple salt was added to bring the starting Eh to a value shown in the following table:

| Starting Eh (mV) | $CN^-$ added (kg/t) | Au extracted (ppm) | % Au extracted | Free $CN^-$ % |
|---|---|---|---|---|
| 50 | 10 | 1.5 | 23 | 35 |
| 100 | 10 | 1.85 | 28 | 20 |
| 100 | 20 | 1.85 | 28 | 55 |
| 200 | 5 | 1.20 | 18 | 0–5 |
| 200 | 10 | 1.2 | 18 | 5–10 |

The Eh rapidly decreased through to negative potentials (usually within 30 minutes). The initial pH rose with the addition of sodium cyanide and then fell when the triple salt was added as a result of its acidic nature. As the leach proceeded the pH gradually increased to 11 to 11.5. These results illustrate a relationship between Eh and gold extraction as one would expect for the redox reaction between gold and cyanide ion.

The work was made more difficult by the refractory nature of the ore. The colour of the solution was light blue in colour when the experiments were performed with triple salt addition to give starting Eh of 50 and 100 mV while those performed at 200 mV were distinctly blue in colour. The blue colour does not arise when the ore is mixed with the triple salt under basic conditions.

Note from the table that increasing the cyanide ion concentration at a fixed starting potential offered no improvement in the extraction of gold. However, although these leaches were carried out for 24 hours more than 85% of the gold was in solution after 4 hours. The results were not encouraging as the conditions were not optimum being performed at high pH (11.5) with consequent decomposition of the triple salt.

Comparative Example 7

A leach was performed using hydrogen peroxide to establish a starting Eh of 100 mV and using 10 kg/t of cyanide. After 4 hours gold extraction was low (16%) and with only 10% of the cyanide remaining.

In the following experiments sulfide bed ore from Sheahan-Grants Mine, Lyndhurst, New South Wales, Australia was used. The ore contains about 2.8 to 2.9 g/t of gold (The assay by crucible fusion at approximately 1000 C. gave an average Au content of 2.9 g/t and all the results describing % of extraction are relative to this amount. Other elements contained in the ore are Fe 15%, $S(SO_4)$, S 5%, As 5000 to 10000 ppm, Cu 400 ppm, Co 10 ppm, Ni 50 ppm and Ag 2 g/t.

Extraction of the ore at Sheahan-Grants Mine is as follows:

The feed is milled to 80% passing 106 μm and about 4 kg/t of lime is added to the mill feed.

A front leach tank is used as an oxidation tank and pure oxygen is injected at a rate of around 1.2 $m^3$/t. with a three hour residence time.

Cyanide is added to a second leach tank at around 2.2 kg/t and to a first absorption tank at around 0.3 kg/t.

Comparative Example 8

Four Runs were carried out to determine the base level of gold extraction using alkaline cyanide. The reaction was performed in a glass reaction vessel with a stirrer. 100 g of ore in a 3:1 liquid:ore ratio was treated at an initial pH of 11.0 (addition of sodium hydroxide) and the pH was adjusted after 6 hours. Cyanide concentrations varying from 1.0 to 10.0 kg/t of ore were used. The results are shown in the following table:

| Run No. | Time (h) | Initial CN concentration (kg/t) | CN consumption (kg/t) | Au extraction (mg/l) | Au extracted (g/t) | Au extracted (%) |
|---|---|---|---|---|---|---|
| 1. | 6 | 1.0 | 0.25 | 0.42 | 1.3 | 45 |
| | 24 | 1.0 | 0.25 | 0.52 | 1.5 | 52 |
| 2. | 6 | 2.0 | 0.6 | 0.42 | 1.3 | 45 |
| | 24 | 2.0 | 0.6 | 0.52 | 1.5 | 52 |
| 3. | 6 | 5.0 | 2.2 | 0.45 | 1.4 | 48 |
| | 24 | 5.0 | 2.2 | 0.55 | 1.5 | 52 |
| 4. | 6 | 10.0 | 4.7 | 0.45 | 1.4 | 48 |
| | 24 | 10.0 | 4.7 | 0.55 | 1.5 | 52 |

The results are typical for sulfur rich-oxygen deficient ores. It can be seen from the above Table that increasing the cyanide levels has no beneficial effect. This is to be expected as the reaction system needs more oxidant not cyanide.

Comparative Example 9

Experimental conditions were the same as for Comparative Example 8 run 3 however in this experiment oxygen was provided to the leach solution by bubbling through Micro 2 (A Porous Pipe). The results are shown in the following table.

| Run No. | Time (h) | Initial CN concentration (kg/t) | CN consumption (kg/t) | Au extraction (mg/ml) | Au extracted (g/t) | Au extracted (%) |
|---|---|---|---|---|---|---|
| Comparative Example 8* (Run 3) | 6 | 5.0 | 2.2 | 0.45 | 1.4 | 48 |
| | 24 | 5.0 | 2.2 | 0.55 | 1.5 | 52 |
| Run 1 | 4 | 5.0 | 4.4 | 0.8 | 2.4 | 83 |
| | 6 | 5.0 | 4.6 | 0.83 | 2.5 | 86 |
| | 24 | 5.0 | 4.6 | 0.87 | 1.6 | 90 |

*For comparison

There is no doubt that the addition of gaseous oxygen can dramatically increase the rate of extraction of gold, extraction being substantially complete after 6 hours.

Comparative Example 10

Four runs were carried out to measure the extraction of gold versus electrode potential produced by gradual addition of hydrogen peroxide. 50 grams of ore at 50% solids was treated at a pH of 11 (adjusted with calcium hydroxide) with 2.5 kg of cyanide per tonne of ore. Hydrogen peroxide was added as a 1.0% solution in increments over four hours to maintain the designated electrode potential. The pH did not change during this period. The results are shown in the following table:

| Run No. | Time (h) | Potential (mV) | Initial CN concentration (kg/t) | CN Consumption (kg/t) | $H_2O_2$ added (kg/t) | Au extracted (%) |
|---|---|---|---|---|---|---|
| Run 1 | 6 | −100−−50 | 2.7 | 1.1 | 0.75 | 76–79 |
| Run 2 | 6 | −50–0 | 2.7 | 1.1 | 1.75 | 76–79 |
| Run 3 | 6 | 0–50 | 2.7 | 1.1 | 5.90 | 76–79 |
| Run 4 | 6 | 50–100 | 2.7 | 1.1 | 11.20 | 76–79 |

On comparing this example with that of Runs 2 and 3 of Comparative Example 8 it can be seen that the addition of hydrogen peroxide has substantially increased the % of gold extracted (from 45–48 to 76–79%). The additional amounts of hydrogen peroxide over the lowest amount of 0.75 kg/tonne had no effect on the extraction of gold. The excess hydrogen peroxide is consumed by material contained in the ore and does not react with the cyanide.

Comparative Example 11

The Experimental conditions were the same as for Comparative Example 10 however in this experiment hydrogen peroxide was added in one lot at the commencement of the run. The results are shown in the following table (all results are for 6 hours at an initial pH of 11):

| | Initial CN concentration | CN consumption | $H_2O_2$ added | AU extracted |
|---|---|---|---|---|
| Run No. | (kg/t) | (kg/t) | (kg/t) | (%) |
| Run 1 | 2.7 | 0.7 | 0.75 | 62–66 |
| Run 2 | 2.7 | 0.85 | 1.75 | 69–71 |
| Run 3 | 2.7 | 0.90 | 5.90 | 71–72 |

From the above table it appears that CN consumption is still correlated with gold extraction. The amount of gold extracted is lower than that found in Comparative Example 10. This is because oxygen which was generated early in the experiment has the opportunity to diffuse out of the system.

Comparative Example 12

Experimental conditions were the same as for Comparative Example 10 however in this experiment the effect of pH on the extraction of gold whilst using hydrogen peroxide was examined. In this experiment the electrode potential was kept between −50 and 0 mV by the dropwise addition of 1% hydrogen peroxide. The results are shown in the following table (all results are for six hours and an initial cyanide concentration of 2.7 kg/tonne):

| Run No. | pH | CN consumption (kg/t) | Au extracted (g/t) | Au extracted (%) |
|---|---|---|---|---|
| Run 1 | 10.5 | 1.25 | 2.45 | 84 |
| Run 2 | 11.0 | 1.10 | 2.30 | 78 |
| Run 3 | 11.5 | 0.75 | 2.15 | 74 |

It can be seen that the amount of gold extracted increased with decreasing pH from 11.5 to 10.5 with a correlatory increase in cyanide consumption. Cyanide consumption was greater for Run 1 than Runs 1 to 4 of Comparative Example 10 due to greater gold extraction.

Example 2

Runs 1, 2, 3 and 4 of Comparative Example 8 were repeated however in this instance a solution of oxone TM monopersulfate was added dropwise over the first hour (Runs 1 and 2) or solid oxone monopersulfate was added (Runs 3 and 4) at the beginning of each Run, each in an amount sufficient to maintain negative potentials as shown below during the leach. Please note that usually after the addition of cyanide to the ore mixture the potential falls to below −300 mV.

In Run 1, 5 ml of 0.1M solution of the triple salt was added during the first hour. The Eh (mV) at various intervals in the experiment were: after 1 h −150 mV, after 4 h −150 mV, after 24 h −190 mV.

In Run 2, 10 ml of a 0.1M solution of the triple salt was added over the first hour. The Eh (mV) at various intervals of the experiment were: after 1 h −100 mV, after 4 h −130 mV, after 24 h −185 mV.

In Run 3, 0.19 g/l of the triple salt (equivalent to the amount of triple salt added gradually in Run 2) was added at the beginning of the Run. The Eh (mV) at various intervals in the experiment were: after 4 h −125 mV, after 24 h −210 mV.

In Run 4, the triple salt was added in an amount in order to maintain a potential of 50 mV for the first hour of the leach. The Eh (mV) at various intervals was: after 1 h 50 mV, after 2 h 15 mV, after 6 h −15 mV.

The results are shown in the following table.

| Run No. | Time (h) | Initial CN concentration (kg/t) | CN consumption (kg/t) | Au extracted (mg/l) | Au extracted (g/t) | Au extracted (%) |
|---|---|---|---|---|---|---|
| Comp. Ex. 8* (Run 3) | 6 | 5.0 | 2.2 | 0.45 | 1.4 | 48 |
| | 24 | 5.0 | 2.2 | 0.55 | 1.5 | 52 |
| Run 1 | 6 | 5.0 | 4.5 | 0.62 | 1.8 | 62 |
| | 24 | 5.0 | 4.5 | 0.85 | 2.5 | 86 |
| Run 2 | 6 | 5.0 | 4.6 | 0.55 | 1.7 | 59 |
| | 24 | 5.0 | 4.6 | 0.79 | 2.4 | 83 |
| Run 3 | 4 | 5.0 | 4.6 | 0.87 | 2.6 | 90 |
| | 6 | 5.0 | 4.6 | 0.91 | 2.7 | 93 |
| | 24 | 5.0 | 4.8 | 0.95 | 2.8 | 97 |
| Run 4 | 6 | 1.0 | 0.85 | 0.34 | 1.0 | 34 |
| | 24 | 1.0 | 0.85 | 0.45 | 1.3 | 45 |

From the above results it can be seen that there is a correlation between Eh and gold extraction. As the leach solution becomes more oxidizing (i.e. as the potential becomes less negative) the extraction of gold increases but falls off again at positive potentials. The addition of the triple salt resulting in a potential of between −100 and −150 mV provides good recoveries of gold within 4 hours.

Example 3

The following experiment were conducted to determine what level of oxone is beneficial for the extraction of gold. Seven runs were conducted at a fixed pH of 10.0 with a 2:1 liquid to solid ratio, using a 2.7 kg of cyanide per tonne of ore over a 24 hour period. The results are shown below:

| Run | Volume (ml) 0.008 M oxone | Cyanide consumed (kg/t) | Au extracted (g/t) |
|---|---|---|---|
| Run 1 | 0.25 | 1.0 | 2.55 |
| Run 2 | 0.5 | 1.0 | 2.50 |
| Run 3 | 1.0 | 1.0 | 2.55 |
| Run 3A (solid oxone) | 1.0 | 1.1 | 2.30 |
| Run 4 | 2.0 | 1.0 | 2.60 |
| Run 4A (solid oxone) | 2.0 | 1.1 | 2.30 |
| Run 5 | 5.0 | 1.0 | 2.55 |
| Run 5A (solid oxone) | 5.0 | 1.2 | 2.20 |
| Run 6 | 10.0 | 1.15 | 2.30 |
| Run 6A (solid oxone) | 10.0 | 1.55 | 1.95 |
| Run 7 | 20.0 | 1.4 | 1.90 |
| Run 7A (solid oxone) | 20.0 | 1.8 | 1.60 |

The results show that gold extraction is not favoured by high levels of oxone. There is an optimal amount (see Run 4). With higher levels of oxone there is an increase in dissolution of iron as indicated by the appearance of a distinct blue colour in the leach solution. Qualitative analysis revealed that Run 7 contained significantly more iron than the other runs. Cyanide consumption did not increase until very high levels of oxone were present (Runs 6 and 7). Runs designated as "solid oxone" were performed by the single addition of solid oxone equivalent to the amount added as a solution. All of these Runs produced a significantly lower level of extraction than the corresponding solution. The cyanide consumption was also higher.

Example 4

Example 3 was repeated however in this example oxygen gas was also present. Run 1 was performed with oxygen bubbling through microporous tubing but with no oxone addition. Runs 2 and 3 were performed with oxygen and oxone. The results are shown in the following table:

| Run | Volume (ml) 0.008M oxone | Cyanide consumption (kg/t) | Au extracted (g/t) |
|---|---|---|---|
| Run 1 | 0.0 | 1.1 | 2.25 |
| Run 2 | 1.0 | 1.9 | 2.55 |
| Run 3 | 5.0 | 1.9 | 2.55 |

Runs 2 and 3 show no increase in gold extraction over Runs 3 and 5 of Example 3. It appears that sufficient oxygen is present in solution at ambient conditions (approximately 8 ppm) to allow the performance of oxone. Cyanide consumption increased.

Example 5

The following experiment was conducted to ascertain the importance of dissolved oxygen to oxone TM assisted gold dissolution. Nitrogen gas was bubbled through porous tubing (Leaky Pipe micro pore) to lower the levels of oxygen in solution. Oxygen was measured with a standardised oxygen electrode with freshly prepared teflon membranes. A solid:liquid ratio of 2.5:1 was used with added cyanide at 2.7 kilograms per tonne at a pH of 10.0 and with 24 hour leach time. The results are shown in the following table:

| Run | $O_2$ ppm | Oxone M | Eh 24 h mV | Au extracted (g/t) | Au extracted (%) |
|---|---|---|---|---|---|
| 1 | Sat | — | −15 | 2.35 | 80 |
| 2 | 9 | $2 \times 10^{-4}$ | −40 | 2.45 | 83 |
| 3 | 5 | $2 \times 10^{-4}$ | −60 | 2.20 | 75 |
| 4 | 0-1 | $2 \times 10^{-4}$ | −75 | 2.10 | 71 |
| 5 | 0-1 | — | −95 | 2.10 | 71 |
| 6 | 9 | — | −60 | 2.25 | 76 |

The results clearly demonstrate that oxygen levels in the leach solution affect the potential of the leach slurry. Even when oxygen is present at 5 ppm and in the presence of oxone there is poor gold extraction. Runs 4 and 5 where the leach solution was virtually saturated with nitrogen at the expense of oxygen gave the lowest recoveries of gold. For oxone to operated at maximum effect a dissolved oxygen levels of at least 8 to 10 ppm oxygen in the leach solution is required.

From Examples 2 to 5 it can be concluded that oxone does increase the amount of gold extracted. The addition of dilute solutions of oxone is better than adding the oxone as a solid. High oxone levels to not assist the extraction of gold but are conducive to the extraction of iron. There appears to be no need for additional oxygen provided there is sufficient oxygen present i.e. at least 6 ppm.

Example 6

Figure 2:
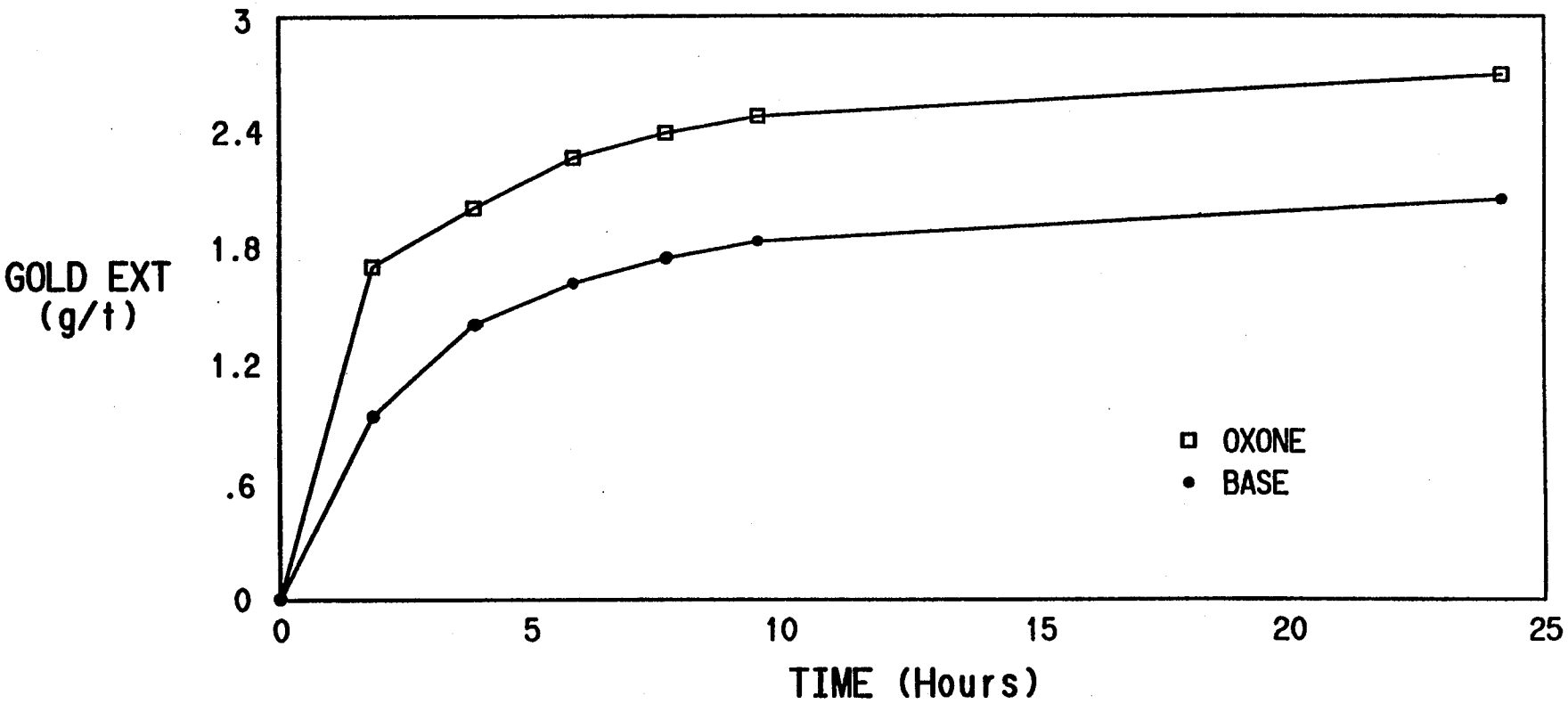
FIG. 2 is a graph of gold extraction versus time from Sheahan-Grants Sulfide ore.

The rate of oxone assisted leach employing 20 mls of 0.01M oxone solution/kg of ore was compared with base conditions. The results are shown in FIG. 2. With oxone a gold recovery of 93.4% was achieved. Without oxone a gold recovery of 72.4% was achieved. Oxone increased gold dissolution by 21%. Aqueous oxygen levels for both runs was 7.8 ppm. From FIG. 2 it can be seen that within 4 hours oxone significantly increased the dissolution of gold.

In the following examples a recently mined sulfide bed ore from Sheahan Grants Mine, Lyndhurst, New South Wales was used. The ore is refractory and gold recovery has been low. The gold content of the ore is not known.

Comparative Example 13

An experiment was conducted with 50 g ore at a 2:1 liquid to ore ratio under standard cyanide conditions. Ore was treated at an initial pH of 10.00 and with a cyanide concentration of 2.7 kg per tonne of ore for 24 hours. The amount of gold extracted was 1.2 g per tonne with a cyanide consumption of 1.2 kg per tonne. The percentage of gold extracted was 30% (based on an estimated gold content of 4 g per tonne in the feed). This should be compared with the results shown in Comparative Example 8 where 1.5 g/t was recovered (52%).

Comparative Example 14

The experimental conditions of Comparative Example 10 was used with the incremental addition of hydrogen peroxide to maintain a desired electrode potential however due to the highly reducing nature of the ore the ore rapidly consumed the added hydrogen peroxide and it was not possible to maintain a potential between −50 and 0 mV. This experiment was abandoned.

Comparative Example 15

The experimental conditions were similar to that of Comparative Example 11. Three runs were conducted with the addition of a single amount of hydrogen peroxide at the start of each run. In Run 1 the ore was leached at 50% solids with a standard cyanide concentration of 2.7 kg/tonne and at a pH of 10.0. The Eh stabilized at −235 mV. Upon addition of an equivalent of 22.5 L of 0.1% hydrogen peroxide solution per tonne or ore (similar to Comparative Example 11) the Eh rose immediately and then fell to −180 mV within 5 minutes indicating that the oxidant was rapidly destroyed. From then on the Eh rose very slowly to reach −140 mV after 24 hours. Runs 2 and 3 were conducted under similar conditions to that of Run 1 however an equivalent of 50 and 100 L of 0.1% hydrogen peroxide solution per tonne of ore was used. Again the Eh rose sharply but settled to about −180 mV within several minutes. The Eh then rose slowly to reach −90 mV after 24 hours. The ore rapidly consumed hydrogen peroxide. The change in Eh after the initial rapid equilibrium was in the range of +40 to 50 mV i.e. change in Eh was +40 to 50 over a 24 hour period. The slow rise in Eh is possibly an indication of the cyanide consumption. The pH in the three runs deceased slowly but only in the order of 0.3 to 0.4 pH units. The results are shown in the following table:

| Run No. | Time (h) | Initial CN concentration (kg/t) | CN Consumption (kg/t) | $H_2O_2$* added (kg/t) | Au extracted (g/t) |
|---|---|---|---|---|---|
| Comparative Example 13. | 24 | 2.7 | 1.2 | 0 | 1.2 |
| Run 1 | 24 | 2.7 | 1.6 | 22.5 | 1.4 |
| Run 2 | 24 | 2.7 | 1.6 | 50.0 | 1.4 |
| Run 3 | 24 | 2.7 | 1.6 | 100.00 | 1.45 |

*$H_2O_2$ added as a 0.1% solution.

The results indicate that increased addition of hydrogen peroxide has no effect on cyanide consumption (i.e. hydrogen peroxide is not reacting with cyanide) and has little or no effect on the recovery rate of gold.

Example 7

Five runs were conducted with the addition of Oxone. Run 1 was similar to that of Comparative Example 15. After the addition of cyanide the Eh dropped to −230 mV. Slow addition of an oxone solution equivalent to 50 L of 0.01% solution per tonne of ore (equivalent to 600 g/t) caused the Eh to rise sharply at first and then fall to −175 mV after several minutes. The Eh of the reaction mixture than began to rise slowly reaching −85 mV at the end of 24 hours. In Runs 2 to 5 0.3, 0.6, 2.0 and 5.0 kg/tonne of oxone were added directly as the solid in a single step at the commencement of each run. After an initial rapid rise and fall in Eh the equilibrium Eh measurements were in the range −180 to −170 mV. In these runs the pH was relatively stable decreasing by only a few tenths of a pH unit. The results are shown in the following table (all results are for runs of 24 hours with an initial CN concentration of 2.7 g/t and a pH of 10.0):

| Run No. | Oxone added 0.01M L/t | Oxone added (g/t) | CN consumption (g/t) | Au extracted (g/t) |
|---|---|---|---|---|
| Run 1 | 50 | | 2.0 | 2.8 |
| Run 2 | | 300 | 2.0 | 2.4 |
| Run 3 | | 600 | 2.0 | 2.3 |
| Run 4 | | 2000 | 2.0 | 1.9 |
| Run 5 | | 5000 | 2.0 | 1.6 |

It can be seen from the above results that oxone has increased the recovery of gold. Lower concentration of Oxone appear to enhance recovery rates for gold with a recovery of 2.8 g of gold per tonne as compared with 1.4 grams when using hydrogen peroxide and 1.2 grams when using standard cyanide conditions. An excess of oxone appears to be detrimental to the extraction of gold.

In the following examples an ore sample from Kalgoorlie, Western Australia, Australia was used. The ore sample was a refractory residue from an ashing operation. The estimated gold content of the ore is 100 g/tonne. The amount of gold in the sample was assayed in triplicate by digestion in aqua regia followed by AAS to give an average gold content of 105 g/tonne.

Comparative Example 16

An experiment was conducted to study the relationship between the ratio of liquid to solid phase with respect to the suspended phase and gold extraction. Cyanide levels were initially 2.5 kg/t or ore while the initial pH was adjusted to 11.0. Samples were extracted for 24 h which led to a drop in pH. The results are shown in the following table:

| Run | pH 24 h | solid:liquid | oxygen | CN Consumption (kg/t) | Au extracted (kg/t) | Au extracted % |
|---|---|---|---|---|---|---|
| 1 | 10.0 | 1:12.5 | saturated | 1.65 | 42.0 | 40.0 |
| 2 | | 1:12.5 | ambient | 1.65 | 42.0 | 40.0 |
| 3 | | 1:20.0 | saturated | 1.5 | 48.5 | 46.0 |
| 4 | | 1:20.0 | ambient | 1.5 | 48.5 | 46.0 |
| 5 | 10.7 | 1:33.0 | ambient | 1.0 | 55.5 | 51.0 |
| 6 | | 1:7.5 | ambient | 1.75 | 32.5 | 31.0 |
| 7 | | 1:2.5 | ambient | 1.9 | 22.0 | 21.0 |

Although the ratio of CN to ore was fixed increasing the volume of the liquid phase results in a decrease in the concentration of cyanide in the slurry. The trends in Eh for Runs 1 to 6 were:

| | Eh (mV) | | | | | |
|---|---|---|---|---|---|---|
| Time h | Run 1 | Run 2 | Run 3 | Run 4 | Run 5 | Run 6 |
| 0.25 | 35 | 28 | — | 65 | 60 | 32 |
| 0.5 | 28 | 17 | — | — | 53 | 26 |
| 1.75 | 5 | 10 | 6 | 47 | 36 | 5 |
| 2.0 | 13 | 1 | — | 40 | 28 | 4 |
| 2.25 | 14 | −2 | 16 | — | — | 2 |
| 3.5 | 18 | 5 | 20 | 29 | 19 | 2 |
| 4.0 | 18 | 4 | 21 | 26 | 17 | 2 |
| 24.0 | 22 | 4 | 26 | 10 | 8 | 2 |

In each of these runs the equilibrium Eh after base addition was recorded at approximately 40 mV prior to cyanide addition. After the addition of cyanide the Eh rose sharply to about 100 mV within seconds and then fell at a decreasing rate. As liquid to solid ratios are increased a distinct increase in free CN is obtained in solution. The consumption of cyanide was determined using a selective electrode. During Run 6 80% more cyanide was consumed than in Run 5 with a 20% increase in gold dissolution. An addition of oxygen saturation of the solution phase did not enhance gold dissolution. The equilibrium Eh values of the ore sample are typical of a suspension of colloidal metal oxides with an increase of acid sites. On the other hand the Sheahan-Grants ore is a highly reducing ore rich is sulfides and exhibiting relatively lower Eh values. Employing oxygen saturation of the solution phase did not enhance gold dissolution.

EXAMPLE 8

Ten runs were conducted. The pH was kept constant. A 2.5:1 liquid to solid ratio at an initial pH of 10.0 and a sodium cyanide concentration of 5 kg/tonne was used. The residue was basic with a slurry pH of 8.9 prior to the addition of calcium hydroxide. The pH dropped slowly during the leach and was returned to pH 10 by periodic addition of calcium hydroxide. All leaches were for 24 hours. The results are shown in the following table:

| Run | Oxygen (ppm) | Oxone (ml 0.01%) | $H_2O_2$ added (ml 0.1%) | CN consumption (kg/t) | Au extracted (g/t) | Au extracted (%) |
|---|---|---|---|---|---|---|
| 1 | 12 | — | — | 1.9 | 18.0 | 17 |
| 2 | saturated | — | — | 2.05 | 18.5 | 17.5 |
| 3 | ambient | 1.0 | — | 1.2 | 17.3 | 16.5 |
| 4 | ambient | 2.0 | — | 1.2 | 18.5 | 17.5 |
| 5 | ambient | 5.0 | — | 1.35 | 19.7 | 19.0 |
| 6 | ambient | — | 0.5 | 1.05 | 17.0 | 16.0 |
| 7 | ambient | — | 1.0 | 1.25 | 17.5 | 16.5 |
| 8 | ambient | — | 2.5 | 1.40 | 18.1 | 17.0 |
| 9 | ambient | — | — | 0.95 | 16.9 | 16.0 |
| 10 | ambient | — | — | 0.95 | 17.1 | 16.0 |

Addition of hydrogen peroxide gave poor results as it's effect was insignificant when compared to the baseline runs 9 and 10. The use of a saturated oxygen solution gave minimal improvement in gold recovery but this was offset by an increase in cyanide consumption. Run 5 with oxone gave the best recovery with a 3% increase in gold extraction over Runs 9 and 10. The use of oxidants did not assist the recovery of gold using cyanide solutions.

EXAMPLE 9

Example 8 was repeated however in these Runs the pH levels were allowed to fluctuate according to the reaction process.

| Run | Initial pH | pH, 24 h | Oxygen (ppm) | Oxone (ml 0.01%) | Au extracted (g/t) | Au extracted (%) |
|---|---|---|---|---|---|---|
| 1 | 10.5 | 10.35 | saturated | — | 18.8 | 18.0 |
| 2 | 11.0 | 10.6 | saturated | — | 18.9 | 18.0 |
| 3 | 10.5 | 9.8 | ambient | 5.0 | 20.5 | 19.5 |
| 4 | 11.5 | 10.6 | ambient | 5.0 | 19.3 | 18.5 |
| 5 | 11.0 | 10.15 | ambient | 10.0 | 20.2 | 19.0 |
| 6 | 9.5 | 9.3 | ambient | 5.0 | 18.0 | 17.0 |
| 7 | 11.0 | 10.25 | ambient | 5.0 | 20.5 | 19.5 |
| 8 | 11.0 | 10.3 | ambient | 10.0 | 20.2 | 19.2 |
| 9 | 11.8 | 11.0 | ambient | 5.0 | 17.8 | 17.0 |
| 10 | 12.15 | 11.35 | ambient | 5.0 | 17.0 | 16.0 |
| 11 | 10.75 | 10.25 | ambient | — | 17.3 | 16.5 |

There was little significant effect in varying the pH of the leach. The small changes in gold recovery make it difficult to draw conclusions though on comparing Run 3 with Run 5 and Run 7 with Run 8 it appears that excess oxone does not assist gold extraction. An initial pH of 10.5 to 11.0 is optimal.

EXAMPLE 10

Example 8 was repeated however in this experiment the liquid to solid ratios were changed to alter the solution potentials to more desirable levels. The initial pH was adjusted to 11.0 but gradually fell away during the 24 h leach time. The results are shown in the following table:

| Run | pH 24 h | Solid:liquid | Oxygen (ppm) | Oxone (ml 0.01%) | Au extracted (g/t) | Au extracted (%) |
|---|---|---|---|---|---|---|
| 1 | 10.5 | 1:5 | saturated | — | 20.1 | 19.0 |
| 2 | 10.6 | 1:8 | saturated | — | 25.2 | 24.0 |
| 3 | 10.8 | 1:10 | saturated | — | 30.9 | 29.5 |
| 4 | 10.4 | 1:5 | ambient | 10.0 | 23.0 | 22.0 |
| 5 | 10.6 | 1:8 | ambient | 10.0 | 28.7 | 27.5 |
| 6 | 10.8 | 1:10 | ambient | 10.0 | 32.3 | 31.0 |

The equilibrium potentials were all in excess of 0 mV with respect to calomel and thus the material is oxidizing. The experiments were conducted at elevated liquid to solid ratios. Extractions were significantly higher.

Consistent with Comparative Example 16 an increase in the liquid phase volume enhanced gold dissolution. The addition of oxone had little effect on gold dissolution and it would appear that the ore is not responsive to the addition of oxidants.

In the following Examples Stawell ore from Western Mining Corporation was used. The ore is low to medium in graphite and pyrrhotite. Bottle roll test with and without carbon using 2 kilogram per tonne of ore of cyanide and a pH of 10 to 10.5 revealed enhanced recovery using carbon in leach. Without carbon a head grade of 2.19 and solid tail grade of 1.84 was achieved with a recovery of 15.98%. With carbon a head grade of 2.19 and solids tail grade of 0.70 was achieved with a recovery of 68.04%. Assaying the sample by aqua regia digestion followed by AAS revealed an average gold content of 2.08 grams per tonne of ore.

EXAMPLE 11

Using 2 kg/t sodium cyanide at a pH of 10.0 and at a liquid:solid ratio of 2.5:1 gave the following results:

| Run | Oxone (ml/kg [0.01]) | Oxygen (ppm) | Carbon (kg/t) | Free CN [Cn—] | Au Tails (g/t) | % recovery |
|---|---|---|---|---|---|---|
| 1 | — | 7.9 | 2.5 | 0.016 | 0.45 | 78.4 |
| 2 | — | 7.9 | 5.0 | 0.010 | 0.43 | 79.3 |
| 3 | 50 | 7.9 | 2.5 | 0.005 | 0.39 | 81.3 |
| 4 | 50 | 7.9 | 5.0 | 0.004 | 0.35 | 83.2 |
| 5 | 50 | 7.9 | 10.0 | 0.002 | 0.30 | 85.6 |
| 6 | 75 | 7.9 | 2.5 | 0.011 | 0.27 | 87.0 |
| 7 | 75 | 7.9 | 5.0 | 0.010 | 0.24 | 88.5 |
| 8 | — | 12.0 | 5.0 | 0.015 | 0.44 | 78.8 |
| 9 | — | sat | 5.0 | 0.010 | 0.43 | 79.3 |

The results show that oxone provides enhanced gold dissolution for the ore. The addition of 50 mls of 0.01M freshly prepared solution of oxone per kilogram of ore resulted in a drop in Eh after equilibrium. The duration of this drop was about 30 minutes. The addition of 75 mls of 0.01M oxone per kilogram or ore resulted in a drop in Eh for a more prolonged period. The respective results shown in the Table reflect these trends at the standard calomel electrode. Runs 1 and 2 were baseline runs with different amounts of carbon. A small but significant increase in gold extraction was noted when the carbon levels were doubled as in Run 2. The effect of increased carbon was more pronounced when oxone was added where an increase in carbon in the pulp clearly increased yields. In Runs 8 and 9 oxygen was introduced to the solution via microporous tubing to give 12 ppm and a saturated solution. The results indicate that the addition of oxygen to the slurry imparted no significant advantage compared with the baseline run 2. The addition of dilute oxone solution did not result in elevation of dissolved oxygen beyond 7.9 ppm at pH 10.0.

EXAMPLE 12

Example 11 was repeated using 2 kg per tonne of ore of NaCN at a pH of 10.0 and with a liquid:solid ratio of 2.5:1. Carbon was added at 2.5 kg per tonne of ore. The results are shown in the following table:

| Run | $H_2O_2$ (ml/kg) [.1% v/v] | Oxone ml/kg [0.01]) | $O_2$ (ppm) | Free CN [$CN^-$] | Cu extracted (g/t) | Au tails (g/t) | % recovery |
|---|---|---|---|---|---|---|---|
| 1 | — | — | 8 | 0.017 | 43.8 | 0.49 | 76.4 |
| 2 | 25.0 | — | 8 | 0.005 | 46.0 | 0.49 | 76.4 |
| 3 | 50.0 | — | 8 | 0.003 | 45.1 | 0.56 | 73.1 |
| 4 | 75.0 | — | 8 | 0.002 | 44.8 | 0.62 | 70.2 |
| 5 | — | 75.0 | 8 | 0.010 | 48.9 | 0.29 | 86.1 |
| 6 | — | 100.0 | 8 | 0.007 | 48.1 | 0.45 | 78.4 |
| 7 | — | 125.0 | 8 | 0.005 | 45.4 | 0.63 | 69.7 |
| 8 | — | — | sat. | 0.011 | 44.0 | 0.50 | 76.0 |

The table shows the beneficial effect of adding oxone. Run 6 in Example 11 and Run 5 above are duplicates with gold recoveries of 87.0 and 86.1% respectively. The use of 75.0 mls of 0.01M oxone at pH 10 gave the best recovery. When higher amounts of oxone were used gold recovery was depressed (see Runs 6 and 7).

Addition of hydrogen peroxide gave no improvement over the base line runs of 1 and 2 in Example 11 and run 1 above. Addition of oxidant slightly increased the signal at the oxygen probe (for example in Run 4 the DO quickly rose to 9.2 but equilibrated back to 8.0 within a few minutes). A similar effect was observed in the runs using larger amounts of oxone (in runs 6 and 7 the brief increase in DO indicated that some disproportionation of oxone to oxygen had occurred and this correlated with decreased gold dissolution). The pregnant slurries were scanned using atomic emission spectroscopy to reveal that the major metal co-extracted with gold was copper. The amounts of gold extracted are shown in the above table. Stawell ore is tractable to oxidation with dilute oxone solution. Using condition of pH 10.0 and DO levels of 8 ppm, addition of 75 mls per kg of oxone enhanced the gold recovery from 76 to 86%.

INDUSTRIAL APPLICABILITY

The process of the invention is useful in the extraction of gold from gold containing ores. The process of the invention could also be useful in the extraction of other metals from metal-containing materials.

We claim:

1. A process for extracting precious metals from a precious metal-containing material which comprises mixing the material in a finely-divided state with an alkaline cyanide solution containing peroxymonosulfuric acid or a salt thereof while maintaining the dissolved oxygen level at least about 6 ppm.

2. The process of claim 1 wherein the precious metal-containing material is gold ore.

3. The process of claim 1 wherein the peroxymonosulfuric acid or salt thereof is the triple salt comprising two moles of potassium monopersulfate, one mole of potassium hydrogen sulfate, and one mole of potassium sulfate.

4. The process of claim 1 wherein the dissolved oxygen level is maintained by the addition of oxygen or a source thereof and the level of oxygen is maintained at least about 8 ppm.

5. The process of claim 1 wherein the pH is maintained between 11.5 and 9.5.

6. The process of claim 5 wherein the pH is less than 10.5.

7. The process of claim 1 in which the amount of peroxymonosulfuric acid or salt thereof is between 30 g and 1 kilogram per ton of precious metal-containing material.

8. The process of claim 1 wherein the peroxymonosulfuric acid or salt thereof is added as a dilute solution.

9. The process of claim 1 carried out in conjunction with a carbon-in-pulp process.

* * * * *